US010172756B2

(12) United States Patent
Jonsson

(10) Patent No.: US 10,172,756 B2
(45) Date of Patent: Jan. 8, 2019

(54) HOIST APPARATUS

(75) Inventor: Jorgen Jonsson, Horlösa (SE)

(73) Assignee: Arjo IP Holding AB, Malmo (SE)

( * ) Notice: Subject to any disclaimer, the term of this patent is extended or adjusted under 35 U.S.C. 154(b) by 0 days.

(21) Appl. No.: 14/009,720

(22) PCT Filed: Mar. 28, 2012

(86) PCT No.: PCT/EP2012/055547
§ 371 (c)(1),
(2), (4) Date: Dec. 30, 2013

(87) PCT Pub. No.: WO2012/136542
PCT Pub. Date: Oct. 11, 2012

(65) Prior Publication Data

US 2014/0182059 A1 Jul. 3, 2014

(30) Foreign Application Priority Data

Mar. 28, 2012 (EP) ..... 11160978

(51) Int. Cl.
*A61G 7/10* (2006.01)

(52) U.S. Cl.
CPC ..... *A61G 7/1055* (2013.01); *A61G 7/1013* (2013.01); *A61G 7/1049* (2013.01); *A61G 7/1061* (2013.01)

(58) Field of Classification Search
CPC .. A61G 7/1013; A61G 7/1023; A61G 7/1049; A61G 7/10
(Continued)

(56) References Cited

U.S. PATENT DOCUMENTS 832,517 A * 10/1906 Wilt ..... 5/89.1
1,961,119 A * 5/1934 Ettinger ..... 5/89.1
(Continued)

FOREIGN PATENT DOCUMENTS

CN 1184628 A 6/1998
CN 201692218 U 1/2011
(Continued)

OTHER PUBLICATIONS

International Search Report of PCT/EP2012/055547, dated Jun. 29, 2012, 3 pages.
(Continued)

*Primary Examiner* — Nicholas F Polito
*Assistant Examiner* — Ifeolu A Adeboyejo
(74) *Attorney, Agent, or Firm* — The Webb Law Firm

(57) ABSTRACT

A hoist apparatus for use with a hoist for lifting a load is described. The hoist apparatus includes an elongate load bearing member having a longitudinal axis and at least two support points spaced apart along the longitudinal axis. An intermediate support member includes a hoist connection element for connecting the intermediate support member to a hoist, and at least first and second support point connection elements each connecting the intermediate support member to a respective support point of the elongate load bearing member. The first support point connection element is spaced a first distance from the hoist connection element, and the second support point connection element is spaced a second distance from the hoist connection element. Adjustment means adjusts at least one of the first and second distances so as to adjust the orientation of the longitudinal axis of the elongate load bearing member relative to the horizontal.

11 Claims, 9 Drawing Sheets

(58) Field of Classification Search
USPC ..... 5/81.1 R–89.1
See application file for complete search history.

(56) References Cited

U.S. PATENT DOCUMENTS

| | | | | | |
|---|---|---|---|---|---|
| 2,792,052 | A | * | 5/1957 | Johannesen | 297/5 |
| 3,740,778 | A | * | 6/1973 | Jordan et al. | 5/625 |
| 3,754,749 | A | * | 8/1973 | Lyon | A61G 13/02 5/616 |
| 4,194,253 | A | | 3/1980 | Ullven | |
| 4,617,706 | A | * | 10/1986 | Waletzko | 27/28 |
| 4,712,257 | A | * | 12/1987 | James | 5/83.1 |
| 5,077,844 | A | * | 1/1992 | Twitchell et al. | 5/87.1 |
| 5,499,408 | A | * | 3/1996 | Nix | 5/85.1 |
| 5,692,253 | A | * | 12/1997 | Keijser et al. | 5/83.1 |
| 5,708,993 | A | * | 1/1998 | Campbell et al. | 5/86.1 |
| 6,112,346 | A | * | 9/2000 | Agadzi | 5/86.1 |
| 6,219,862 | B1 | | 4/2001 | Horcher et al. | |
| 6,557,189 | B2 | * | 5/2003 | Von Schroeter | 5/86.1 |
| 7,926,132 | B2 | * | 4/2011 | Jordan | 5/626 |
| 2002/0002740 | A1 | | 1/2002 | Schroeter | |
| 2010/0254980 | A1 | | 10/2010 | Cong et al. | |

FOREIGN PATENT DOCUMENTS

| | | | |
|---|---|---|---|
| DE | 29519119 | U1 | 3/1996 |
| DE | 19820508 | C1 | 9/1999 |
| EP | 1169989 | A2 | 1/2002 |
| GB | 2295602 | A | 6/1996 |
| GB | 2337036 | A | 11/1999 |
| JP | 5468094 | A | 5/1979 |
| JP | 10236767 | A | 9/1998 |
| JP | 5764329 | B2 | 8/2015 |
| WO | 2007/066075 | A1 | 6/2007 |
| WO | WO 2008/007222 | A2 | 1/2008 |
| WO | WO 2011/036140 | A1 | 3/2011 |

OTHER PUBLICATIONS

Chinese Office Action dated Jun. 3, 2015, in Chinese Application No. 201280022618.7.

Japanese Office Action (and Translation) dated Jan. 4, 2016, in Japanese Application No. 2014-503073, 7 pages.

* cited by examiner

HOIST APPARATUS

CROSS-REFERENCE TO RELATED APPLICATIONS

This is a U.S. National Phase of PCT/EP2012/055547, filed Mar. 28, 2012, which claims the benefit of priority to EP 11160978.0, filed Apr. 4, 2011, which is incorporated herein by reference.

TECHNICAL FIELD

The present invention relates to a hoist apparatus for use with a hoist for lifting loads. In particular the invention relates to hoist apparatus comprising an elongate load bearing member and an intermediate support member.

BACKGROUND

Hoists are known for lifting loads such as persons, medical or other equipment, and goods which may require lifting and/or transporting. Such loads may require horizontal balancing during lifting or transportation, for example due to their delicate nature, or specific orientation requirements.

Commonly used hoists for lifting a patient from a patient surface include ceiling lifts and sling lifts. These hoists present a large portion of the patient handling in health care and when combined with the right working technique can reduce musculoskeletal disorders among health staff and contribute to a dignified handling of patients.

Ceiling lifts typically comprise a lifting strap for attachment to a stretcher, for lifting patients in a predominantly extended horizontal style, or a sling, for lifting patients in a predominantly seated style. However, seated style lifting is not always appropriate; the condition of some patients may mean that they require horizontal lifting. In order to perform a safe and comfortable horizontal lift, the stretcher must be substantially horizontally balanced. In order to achieve horizontal balancing the patient should be located with their centre of gravity coincident with the axis of the lifting strap. If this is not the case a counterforce must be applied to bring the patient into a horizontal position during the lift.

One way of horizontally balancing a patient lifted by a ceiling lift is to use a stretcher apparatus with an adjustable lifting strap attachment point. The lifting strap attachment point can only be adjusted when the stretcher is unloaded. With such an apparatus a patient is first arranged in the stretcher apparatus, whilst supported by a patient surface. The lifting strap of the ceiling hoist is then shortened to lift the patient in the stretcher apparatus very slightly off the patient surface. The user of the hoist can determine from this action whether or not the stretcher is horizontally balanced. If it isn't, the lifting strap is lengthened, and the patient is thus lowered back onto the patient surface. To adjust the orientation of the stretcher relative to the horizontal the lifting strap adjustment point is adjusted. The lifting strap of the ceiling hoist is then shortened again to lift the patient very slightly off the patient surface, such that the user can determine whether or not the stretcher is horizontally balanced yet. Depending on the experience of the heath staff, this process may need to be repeated a number of times before the stretcher is horizontally balanced.

A general problem with existing apparatus used to lift a patient an extended horizontal lift is that it cannot be adjusted whilst loaded. Additionally, the stretcher apparatus can be heavy and bulky due to the integrated lift strap adjustment mechanism. When a different sized stretcher frame is required, for example, the whole stretcher apparatus including the lift strap adjustment mechanism must be replaced. Horizontal lifting using known equipment can thus be time-consuming and physically challenging.

BRIEF SUMMARY

According to a first aspect of the invention a hoist apparatus for use with a hoist for lifting a load is provided, the hoist apparatus comprising:

- an elongate load bearing member having a longitudinal axis and comprising at least two support points spaced apart along said longitudinal axis;
- an intermediate support member comprising a hoist connection element for connecting the intermediate support member to a hoist, and at least first and second support point connection elements each connecting the intermediate support member to a respective support point of the elongate load bearing member, the first support point connection element being spaced a first distance from the hoist connection element and the second support point connection element being spaced a second distance from the hoist connection element; and
- adjustment means for adjusting at least one of the first and second distances so as to adjust the orientation of the longitudinal axis of the elongate load bearing member in use relative to the horizontal.

Providing hoist apparatus wherein at least one of the first and second distances is adjustable so as to adjust the orientation of the longitudinal axis of the elongate load bearing member in use relative to the horizontal allows adjustment of the longitudinal axis of the elongate load bearing member relative to the horizontal whilst the hoist apparatus is loaded, i.e. whilst a load is being lifted. This can reduce the time taken to balance a load borne by the elongate load bearing member when the hoist apparatus is attached to a hoist.

The orientation of the longitudinal axis of the elongate load bearing member may be able to be adjusted such that it is substantially parallel to the horizontal. The orientation of the longitudinal axis of the elongate load bearing member may be able to be adjusted such that it is at an angle to the horizontal.

The elongate load bearing member is a member which is able to bear a load. The elongate load bearing member may be used for supporting loads such as persons, medical or other equipment, or goods which may require lifting and/or transporting. Such equipment or goods may require horizontal balancing during lifting or transportation, for example due to their delicate nature, or specific orientation requirements. The orientation of the longitudinal axis of the elongate load bearing member may be able to be adjusted so as to substantially horizontally balance a load borne by the elongate load bearing member.

The elongate load bearing member may be detachable from the intermediate support member. In this way, the elongate load bearing member itself does not need to comprise any bulky adjustment mechanism and may thus be smaller and lighter, such that different types of elongate load bearing members may be more easily removed and replaced onto the support.

The elongate load bearing member may be substantially planar. In use the elongate load bearing member may lie in a plane passing through its longitudinal axis.

The elongate load bearing member may be a stretcher frame. The elongate load bearing member may be a stretcher comprising a stretcher frame and a stretcher body for attachment to the stretcher frame. In use the stretcher may support a load such as a patient. The stretcher may support a patient in a substantially fully extended manner.

The stretcher body may comprise a stretcher sling, a strap stretcher or a scoop stretcher. A "stretcher-sling" may comprise a flexible sling material attachable to the stretcher frame. A "strap-stretcher" may comprise a plurality of flexible straps attachable to the stretcher frame. A "scoop-stretcher" may comprise a rigid surface attachable to the stretcher frame. In all cases, the stretchers are connected to a frame, called a "Stretcher-frame" that spreads the load and is coupled to the lifting strap of the lift.

The stretcher body and stretcher frame may be attached to each other by attachment means. The attachment means may be, for example, hooks provided on at least one of the stretcher body and stretcher frame and loops provided on the other of the stretcher body and stretcher frame. The attachment means may be, for example, lugs provided on at least one of the stretcher body and stretcher frame and clips provided on the other of the stretcher body and stretcher frame.

The elongate load bearing member may comprise a single unit. The elongate load bearing member may comprise a plurality of units, such as for example two units. Each of the plurality of units may be separately attached to the intermediate support member. In order to support and spread a load, the elongate load bearing member may comprise a material such as, for example, steel, aluminium, or a composite material. Such materials may have sufficient stiffness and strength to support and spread a load, such as a patient, supported by the elongate load bearing member.

The at least two support points of the elongate load bearing member may comprise fixed attachment means, such as for example hooks or lugs, or receptors for cooperating with hooks or lugs provided on the intermediate support member. The at least two support points of the elongate load bearing member may be flexible attachment means, for example flexible connecting members such as ropes or links.

The intermediate support member may comprise at least two connection elements each connecting, directly or indirectly, the hoist connection element to a support point connection element and in turn to respective support points on the elongate load bearing member. The intermediate support member may comprise a plurality of connection elements, each connecting the hoist connection element to a support point connection element and in turn to respective support points on the elongate load bearing member.

At least one of the elements may be flexible. At least one of the connection elements may be rigid.

Each of the connecting elements may have a length. The length of a first connecting element may be equal to first distance that the first support point connection element is spaced from the hoist connection element, and the length of a second connecting element may be equal to the second distance that the second support point connection element is spaced from the hoist connection element. The length of at least one of the connection elements may be adjustable by the adjustment means so as to adjust the at least one of the first and second distances. Thus, by adjusting the length of at least one of the connecting elements, the orientation of the longitudinal axis of the elongate load bearing member relative to the horizontal may be adjusted.

The intermediate support member may comprise at least one frame member. The at least one frame member may have a substantially longitudinal axis along which the at least first and second support point connection elements are spaced. The at least one frame member may be substantially planar and lie in a plane through its longitudinal axis. The first frame member may comprise the at least first and second support point connection elements each connecting the intermediate support member to respective support points of the elongate load bearing member.

The connecting elements may each connect the hoist connection element to the first frame member and thus to the at least first and second support point connection elements provided on the frame, and in turn to respective support points on the elongate load bearing member.

The intermediate support member may additionally comprise a second frame member. The second frame member may comprise the hoist connection element for connecting the intermediate support member to a hoist element. The first and second frame members of the intermediate support member may be pivotally connected to one another. In use, the second frame member may hang substantially vertically from a hoist, and the first member of the intermediate support member may extend transversely from the first member. An angle may be formed between the two frame members. Relative movement between the two frame members may adjust the angle between the two frame members and thus adjust the orientation of the longitudinal axis of the elongate load bearing member.

Each of the first and second frame members may comprise a single piece or a plurality of pieces. The first frame member may have a generally U-shaped form comprising first and second limbs. The second frame member may have a generally U-shaped form comprising first and second limbs. The first limb of the first frame member may be pivotally connected to the first limb of the second frame member. The second limb of the first frame member may be pivotally connected to the second limb of the second frame member. The intermediate support member may be a spreader bar, such as a motorized spreader bar. A known motorized spreader bar is the Power DPS (Dynamic Positioning System) by ArjoHuntleigh.

The at least first and second support point connection elements of the intermediate support member may comprise fixed attachment means, such as for example hooks or lugs, or receptors for cooperating with hooks or lugs provided at respective support points on the elongate load bearing member. The at least first and second support point connection elements of the intermediate support member may be flexible attachment means, for example flexible connecting members such as ropes or links.

At least one of the at least two support points of the elongate load bearing member and the respective at least two support point connection elements of the intermediate support member may be provided with a lock, such as a latch, so as to secure the elongate load bearing member and the intermediate support member together. Such a lock may comprise a first mechanism which biases the lock into a locked position. In this way the lock may remain in a locked position unless the user applies a counter force to unlock the lock. The first mechanism may comprise at least one of a compression spring, a tension spring, a torsion spring or a weight. The lock may alternatively or additionally comprise a fixed lock such as at least one of a pin or hook.

The elongate load bearing member and the intermediate support member may be connected such that any reduction in effective stroke of the hoist to which the hoist apparatus is attached is minimized. The elongate load bearing member may be connected to the first frame member of the intermediate support member such that the longitudinal axes of the elongate load bearing member and the first frame member are substantially aligned. In particular the longitudinal axes may lie in substantially the same horizontal plane. The elongate load bearing member may be connected to the first frame member of the intermediate support member such that the planes of the elongate load bearing member and the first frame member are substantially aligned. In particular the planes may substantially coincide. By minimizing any reduction in the effective stroke of the hoist, the range of movement of the load lifted by the hoist is maximized.

The adjustment means may comprise a drive means. The adjustment means may be manually or mechanically actuated. Preferably the adjustment means is mechanically actuated. In this way, physical input of the health staff using the apparatus can be reduced.

The adjustment means may comprise a motor unit. The motor unit of the motorized support may be actuated through an interface comprising, for example, push buttons or touch activated screens connected to the motor unit by electric wires, or a wireless interface such as infrared, radio or ultrasound.

The adjustment means may comprise a linear actuator. The linear actuator may be connected at a first end to the hoist connection element and at a second end to a support point connection element and in turn to a support point of the elongate load bearing member. The linear actuator may provide at least one of the at least two connection elements.

The adjustment means may adjust both of the first and second distances so as to adjust the orientation of the longitudinal axis of the elongate load bearing member in use relative to the horizontal.

Where the intermediate support member comprises first and second frame members, the linear actuator may connect the first and second frame members to each other and be actuatable to cause relative movement between said first and second frame members.

The adjustment means may comprise a winch for adjusting the length of at least one of the connecting elements.

The hoist apparatus may comprise a control device having an angle sensor for determining the orientation of the elongate load bearing member relative to the horizontal. Such an angle sensor may comprise, for example, an accelerometer, a tilt sensor, a camera, or other known angle sensor. The control device may be a central processing unit (CPU). The CPU runs software that compares set point and actual value, for angular measurement, and using a set of rules determines what adjustments have to take place for the hoist apparatus to reach the desired position.

Adjustment of the orientation of the elongate load bearing device may be controlled automatically by the control device. The automatic movement may be set so as to achieve substantial horizontal balancing of the loaded elongate load bearing device when attached to a hoist.

The hoist for lifting a load may be a hoist for lifting persons. The hoist may be a ceiling lift having a lifting strap. The hoist connection element may be for attachment to the lifting strap of the ceiling hoist. The hoist may additionally be capable of transporting the lifted load. The hoist may be a sling lift having a lifting arm. The hoist connection element may be for attachment to the lifting arm of the sling lift.

A second aspect of the present invention provides a method of adjusting the orientation of a stretcher frame relative to a hoist, the method comprising:

providing a hoist;

providing a hoist apparatus, the hoist apparatus comprising an elongate load bearing member having a longitudinal axis and comprising at least two support points spaced apart along said longitudinal axis; an intermediate support member comprising a hoist connection element for connecting the intermediate support member to a hoist, and at least first and second support point connection elements each connecting the intermediate support member to a respective support point of the elongate load bearing member, the first support point connection element being spaced a first distance from the hoist connection element and the second support point connection element being spaced a second distance from the hoist connection element; and adjustment means for adjusting at least one of the first and second distances so as to adjust the orientation of the longitudinal axis of the elongate load bearing member in use relative to the horizontal;

attaching the hoist connection element of the intermediate support member to the hoist; and actuating the adjustment means to adjust at least one of the first and second distances and thus the orientation of the longitudinal axis of the elongate load bearing member relative to the horizontal.

The method may comprise the additional step of, supporting a load on the elongate load bearing member and actuating the adjustment means to adjust at least one of the first and second distances and thus horizontally balance the loaded elongate load bearing member.

The invention will now be described, by way of example only, with reference to the accompanying drawings, in which;

DETAILED DESCRIPTION

Figure 1:
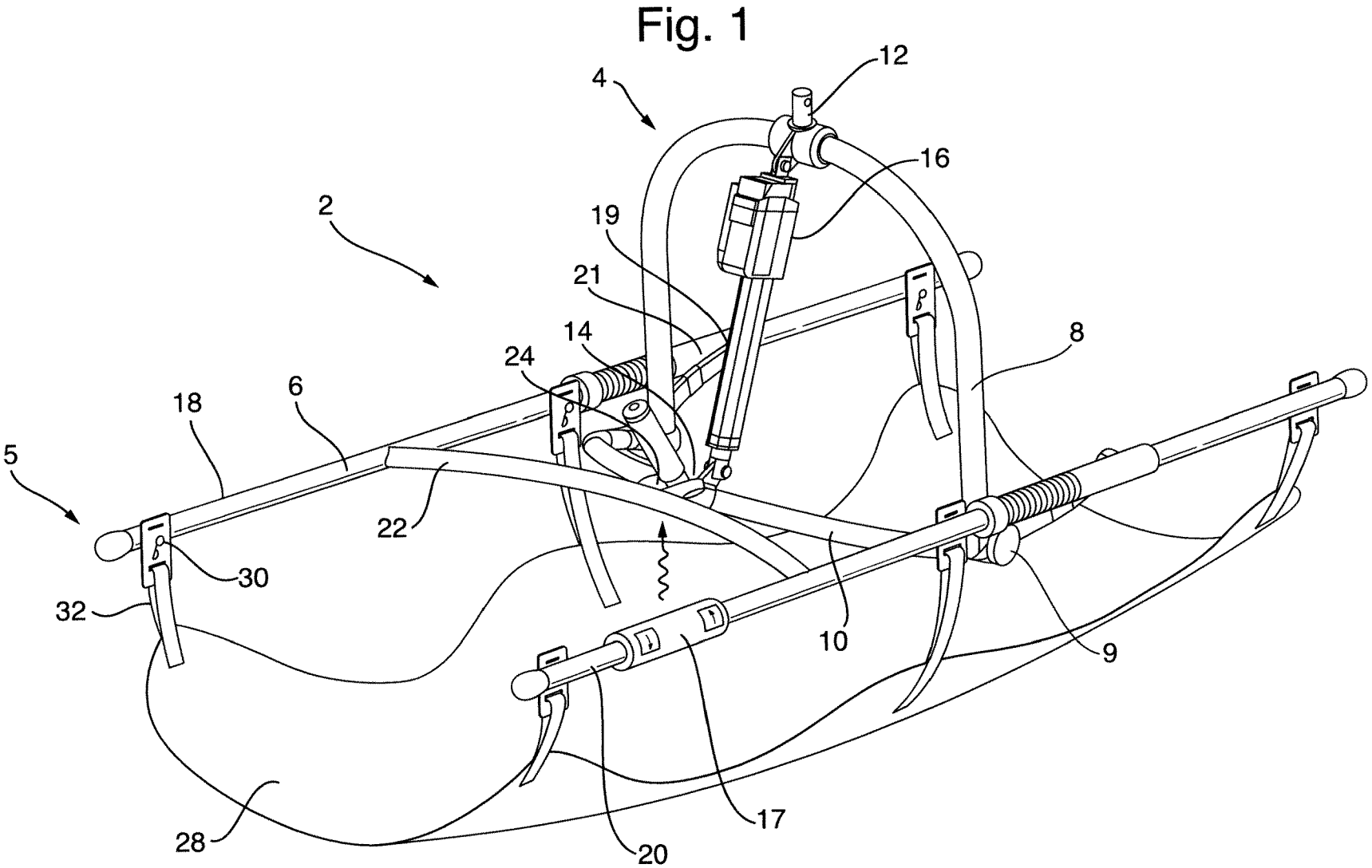
FIG. 1 shows a first hoist apparatus.

FIG. 1 shows a first hoist apparatus 2 for attachment to a ceiling lift. The hoist apparatus comprises an intermediate support member, in the form of support 4, attached to an elongate load bearing member, in the form of a stretcher frame 6. The stretcher frame 6 has support points in the form of an attachment hook 24 and attachment recesses 21. The stretcher frame 6 is attached to a stretcher sling 28, the stretcher frame 6 and stretcher sling 28 forming a stretcher 5.

The support 4 comprises first 10 and second 8 members. The second member 8 has a hoist connection element in the form of a hoist attachment 12 for attachment to a lifting strap of a ceiling lift or the jib of a floor lift. The first member 10 has support point connection elements in the form of first and second attachment points 14, 19 for attachment to the stretcher frame 6. The attachment points 14,19 are located first and second distances respectively from the hoist attachment 12.

The support 4 further comprises an adjustment means in the form of a linear actuator 16. The linear actuator 16 is controlled by a motor unit. The linear actuator 16 can be controlled using push buttons 17 provided on the stretcher frame. The push buttons are in infrared communication with the motor unit of the linear actuator 16. Such a support 4 can be known as a 'motorized spreader bar', as its movement is motorized and it spreads the load of a stretcher attached to it across the support.

The first 10 and second 8 members each have a generally U-shape form comprising two limbs. The limbs of the first member 10 are bent away from the general plane of the U-shape, in a direction perpendicular to the plane of the U-shape. The ends of the two limbs of the second member 8 are pivotally connected to the limbs of the first member 10 at a pivotal connection point 9, such that the ends of the limbs of the first member 10 protrude beyond the pivotal connection point 9. A longitudinal axis of the first member 10 of the support lies substantially parallel to the length of the limbs of first member, through the apex of the first member. The longitudinal axis thus dissects the first member.

The hoist attachment 12 for attachment to a hoist device is located at or near the centre of the apex of the U-shaped second member 8. The first attachment point 14 for attachment to the stretcher frame 6 is located at or near the centre of the apex of the U-shaped first member 10. The second attachment points 19 for attachment to the stretcher frame 6 are located on the limbs of the first member 10. The linear actuator 16 connects the apices of the first and second generally U-shaped members 10,8 to each other. In this arrangement the linear actuator 16 is substantially vertical.

Contraction or extension of the linear actuator 16 causes the first member 10 to pivot about pivot point 9 and thus changes the position of attachment points 14,19 for attachment to the stretcher frame 6 relative to the hoist attachment 12. When in use, actuation of the linear actuator can thus adjust the distances between each of the attachment points 14,19 and the hoist attachment 12 so as to adjust the orientation of the stretcher frame 6 relative to the horizontal. Thus the orientation of a loaded stretcher 5 attached to the support 4 can be adjusted relative to the horizontal, and the load supported can therefore be substantially horizontally balanced as required.

The stretcher frame 6 comprises a generally H-shaped body having two substantially parallel struts 18,20, and a cross strut 22 joining the substantially parallel struts 18,20. A longitudinal axis of the stretcher frame 6 lies substantially parallel to length of the struts, through the centre of the cross strut 22. The stretcher frame 6 comprises essentially a single unit. The stretcher frame 6 has an attachment hook 24 for attachment to the first attachment point 14 on the first member 10 of the support 4, the attachment hook 24 being located at or near the centre of the cross strut 22. The stretcher frame 6 further has attachment recesses 21 for attachment to the second attachment points 19 on the first member 10 of the support.

The stretcher frame 6 further comprises six attachment points 30 for attachment to a stretcher sling 28, three on each of the substantially parallel struts 18,20. The attachment points 30 are positioned proximate to each end of each of the substantially parallel struts 18,20 and at or near the centre of each of the substantially parallel struts 18,20. The stretcher sling 28 comprises six attachment straps and associated clips 32 for attachment to the attachment points 30 on the stretcher frame 6.

The stretcher-frame 6 consists of a structure that can take up the spread load from the lifted body. The stretcher frame 6 is made from steel. Other suitable materials having sufficient stiffness and strength include aluminum or composite materials.

The second attachment points 19 located on the limbs of the first member 10 comprise lugs (15, see FIGS. 2A,B,C) located proximate the end of each limb. The attachments points 14,19 on the first member 10 of the support 4 may be suitable for attachment to a known sling, such as a chair sling. The support shown in FIG. 1 is known from EP2037857 as a motorized 'adjustable spreader bar'. In EP2037857 a flexible chair sling is hung by flexible connections from the adjustable spreader bar, for lifting patients in a predominantly seated style. By enabling the stretcher frame to easily attach to the already existing chair sling attachment points the stretcher frame can be retro-fitted onto existing motorized spreader bars.

Figure 2A:
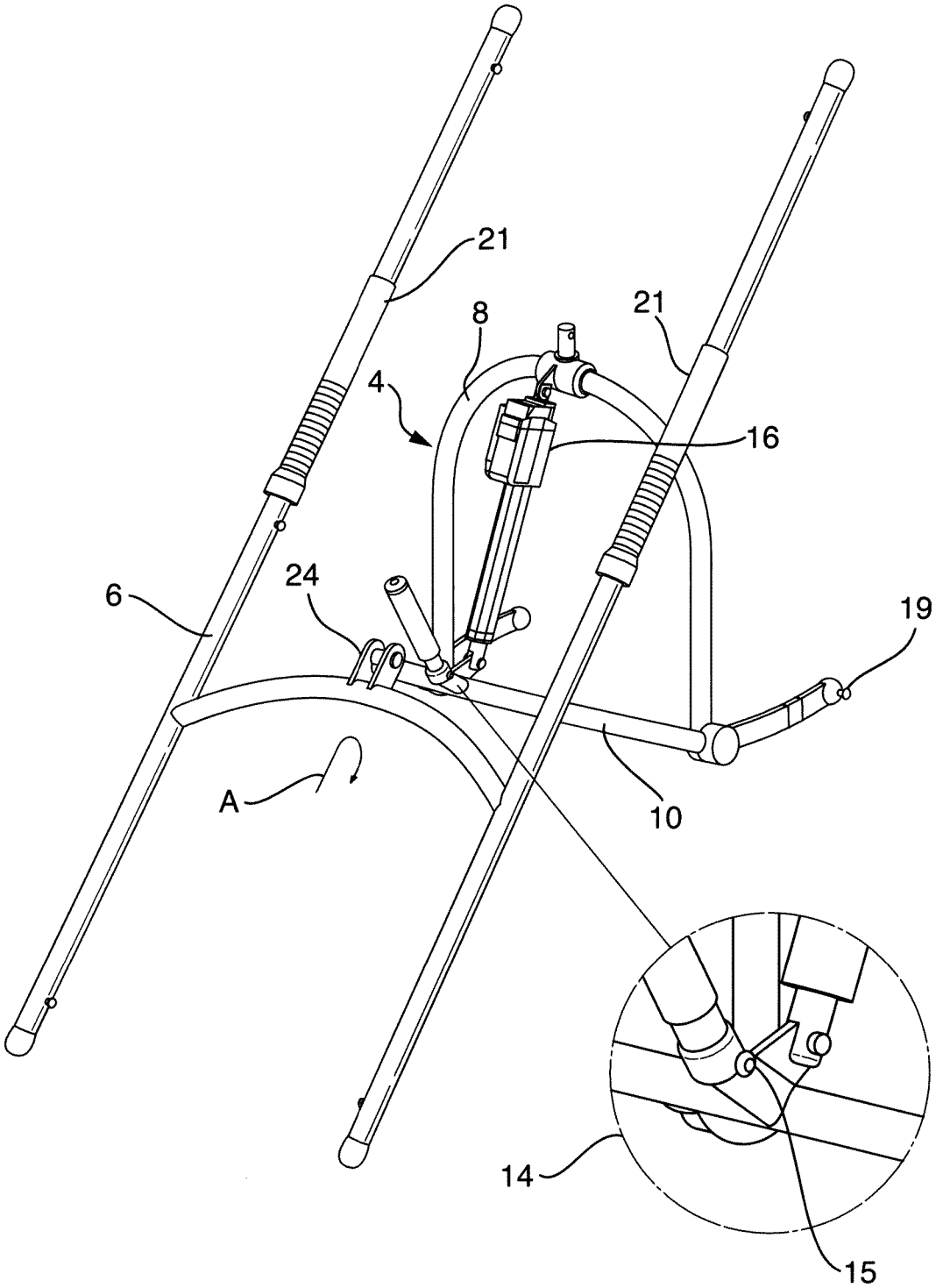
FIGS. 2A, B and C illustrate stages of a method for assembling the first hoist apparatus, as shown in FIG. 1.

FIGS. 2A B and C illustrate stages of a method for assembling the first hoist apparatus 2 as shown in FIG. 1. FIG. 2A illustrates how the stretcher frame 6 can be easily attached to the support 4 using attachment hook 24 to hook (motion following arrow A) the stretcher frame 6 to the first attachment point 14 of the first member 10 of the support. The enlarged view of the first attachment point 14 shows the lugs 15 over which the attachment hook 24 hooks.

Figure 2B:
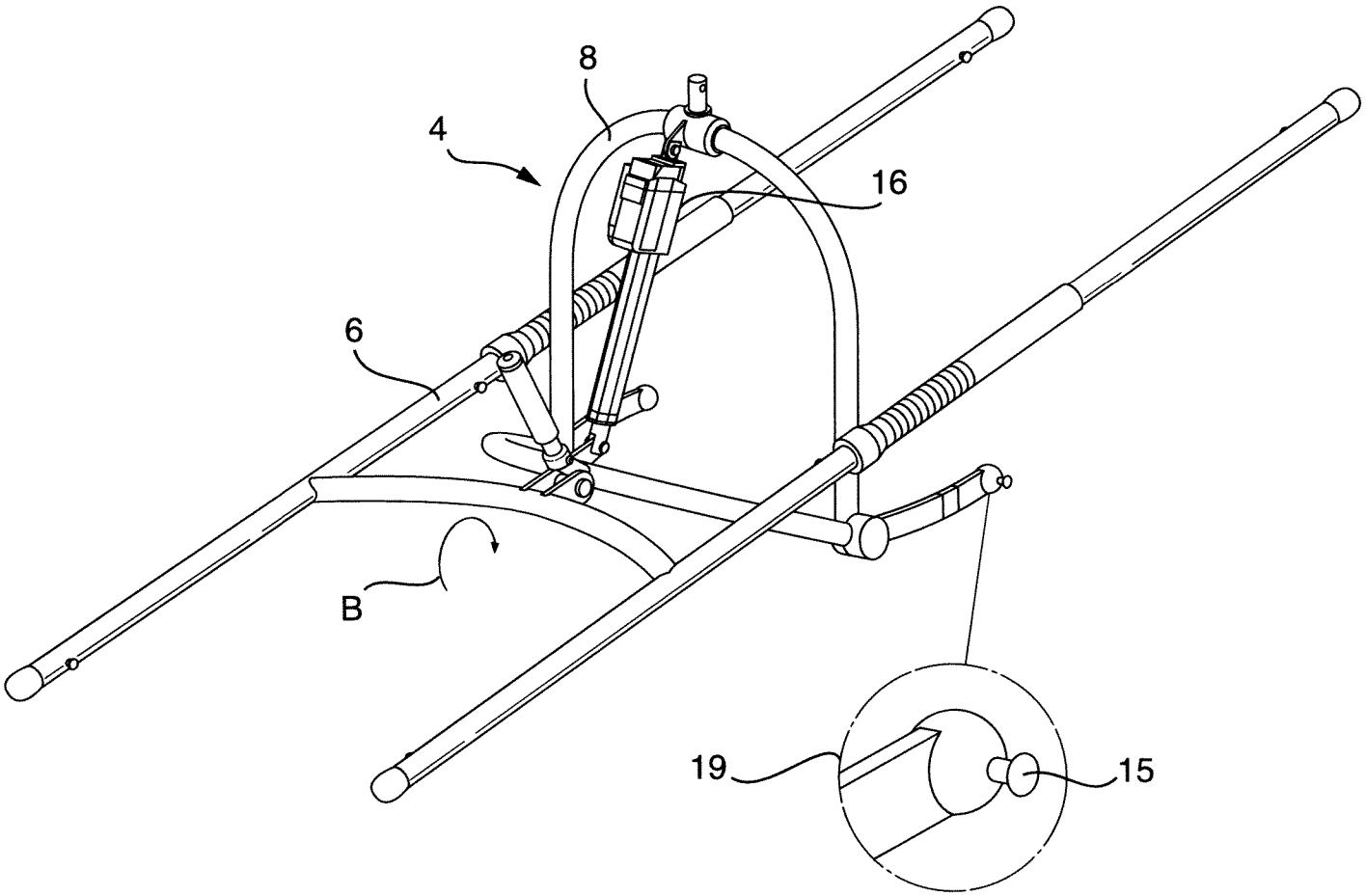

In FIG. 2B the stretcher frame 6 is then rotated about the attachment hook 24/first attachment point 14 connection to bring the ends of the limbs of the first member 10 into line with the struts of the stretcher frame 6 (motion following arrow B). The attachment recesses 21 on the struts of the stretcher frame 6 are then attached to the lugs 15 of the second attachments points 19. In this way the attachment points 14,19 for attaching the support to a chair sling are used for attaching the support to the stretcher frame and thus cannot be used to incorrectly connect a sling body directly to the support.

Figure 2C:
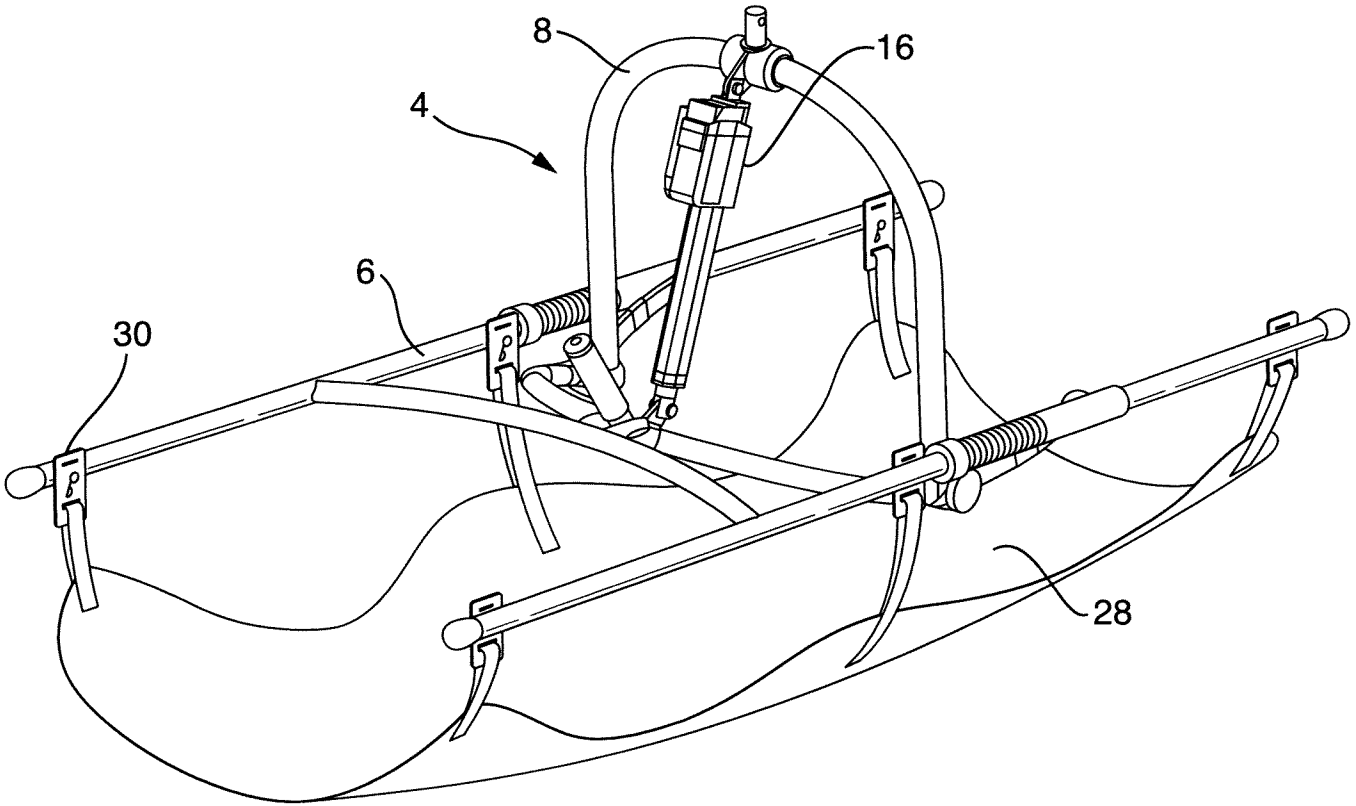

FIG. 2C shows a sling body 28 attached to the stretcher frame 6 which is in turn connected to the support 4, as described with reference to FIG. 1. Substantial horizontal balancing of the stretcher 5 can be performed by operating the motorized linear actuator 16 through an interface with push-buttons (17, FIG. 1) which is in wireless infrared contact with the motor unit of the linear actuator. As can be seen in FIG. 2C the stretcher frame 6 is attached to the first member 10 of the support 4 so that the stretcher frame and first member are substantially in line with one another. The horizontal planes of the stretcher frame 6 and first member 10 are substantially coincident. In this way the hoist apparatus interferes as little as possible with the effective stroke of the hoist to which it is attached. This is in contrast to prior art stretchers which are hung below the hoist or intermediate member and thus occupy more of the effective stoke of the hoist.

Here, the motor-unit is able to adjust the relative positions of the parts of the support, and thus the relative distances of the attachment points 14,19 on the second member of the support and the hoist attachment 12, automatically (i.e. without the user being involved). In order to achieve this, the stretcher frame 6 is provided with a control device having an angle sensor, in the form of an accelerometer, for determining the angle of the stretcher frame in relation to the horizontal plane. The control device further comprises a component for sending control commands to the motor-unit, based on the determined angle of the stretcher frame in relation to the horizontal plane and a preset desired angle, to control movement of the motor unit and thus of the hoist apparatus. In this way the control device can control movement of the hoist apparatus to achieve a desired preset angle of the stretcher frame. A tilt sensor, camera, or other device for measuring an angle may be used in place of the accelerometer.

Figure 3:
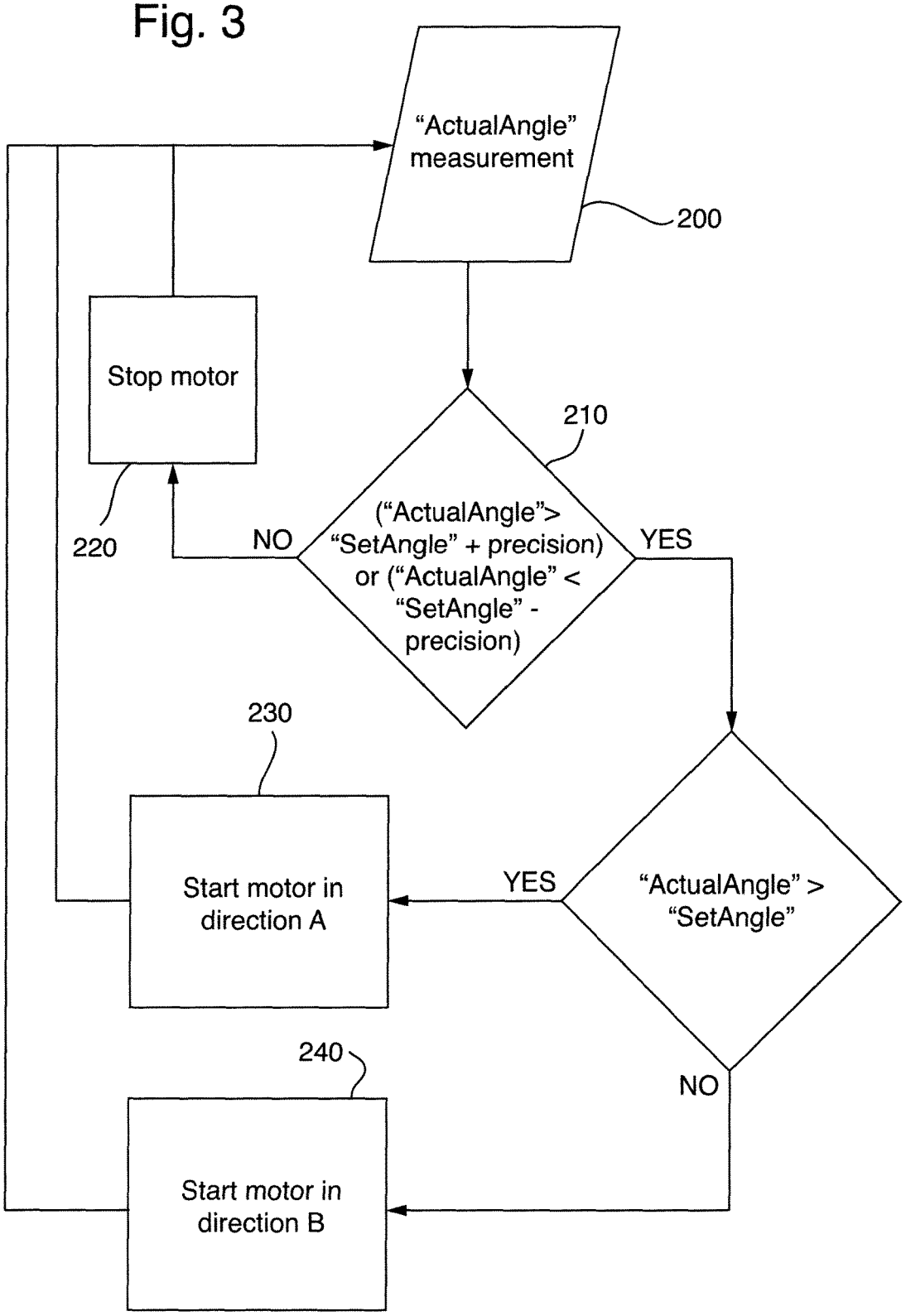
FIG. 3 is a flow chart showing steps involved in adjusting the orientation of the hoist apparatus shown in FIGS. 2A-C.

FIG. 3 is a flow chart showing steps involved in adjusting the orientation of the hoist apparatus shown in FIGS. 2A-C. In a first step 200 the actual angle of the stretcher frame relative to the horizontal is measured. In a second step 210, the value of the actual angle measurement is compared to a desired angle (Set angle+Precision). If the two are equal, a signal is sent to the motor to stop further movement 220. If the value of the actual angle measurement is greater than or less than the desired angle (Set angle+Precision), a signal is sent to the motor to cause the motor to move in the direction required to move the stretcher towards the desired angle 230,240. The first step 200 is then repeated, i.e. the actual angle of the stretcher flame relative to the horizontal is measured again and the process repeats until the actual angle measurement and the desired angle (Set angle+Precision) are equal, when the motor is stopped.

Figure 4:
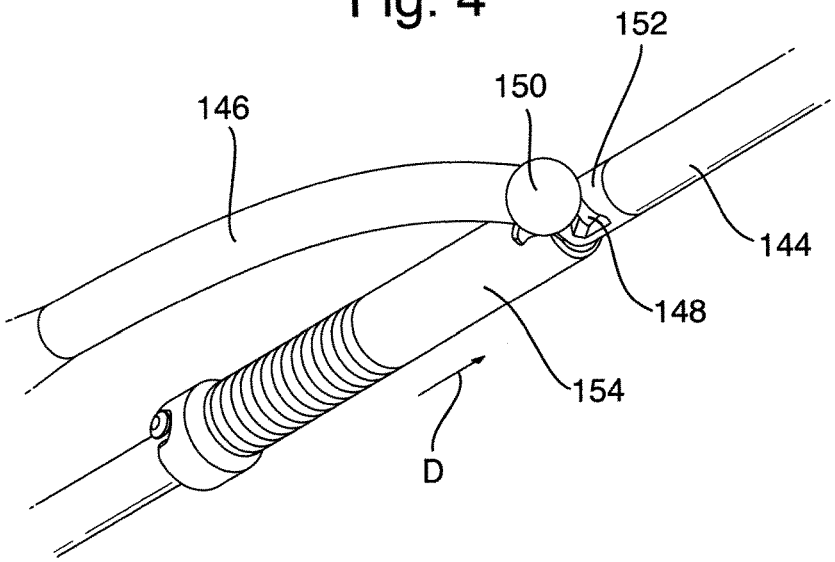
FIG. 4 shows attachment means for securing the stretcher frame to a support.

FIG. 4 shows a locking means 150, located on the stretcher frame 144, for securing the stretcher flame 144 to an attachment lug 148 of the first member 146 of the support. The locking means 150 is used as an extra precaution to prevent the first member 146 of the support and stretcher frame 144 from becoming unintentionally detached from one another during use, or from slipping with respect to one another so as to jolt the patient.

The locking means 150 comprises a recess or suspension point 152 which is brought into engagement with the lug 148 of the first member 146 of the support, and a latch 154 which locks the suspension point 152 relative to the lug 148. The latch follows linear motion arrow D to lock the suspension point 152 relative to the lug 148. Thus the first member 146 of the support and stretcher frame 144 should only be able to be detached from one another when the user applies unlocks the latch. The resulting equipment is thus safer to use.

The locking means 150, before and after being locked shut using the latch, covers the lug 148 of the first member such that it is not possible to attach a stretcher sling clip to the lug 148.

Figure 5:
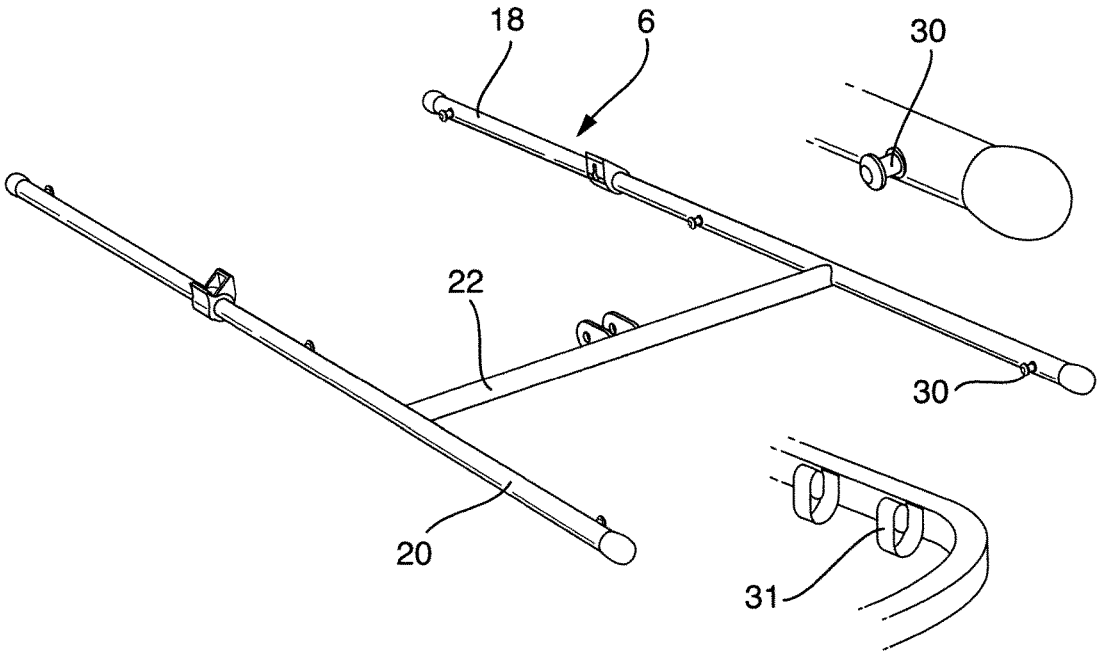
FIG. 5 shows attachment features provided on a stretcher frame for attaching the stretcher frame to a stretcher sling.

FIG. 5 shows attachment features on a stretcher frame used for attaching a sling body 28 to a stretcher frame 6. As shown in FIG. 1, the stretcher frame 6 has six attachment points in the form of lugs 30 for attachment to a stretcher sling 28, three on each of the substantially parallel struts 18,20. It will be understood by the skilled person that the attachment points are arranged so as to spread the load supported by the stretcher sling 28 across the stretcher frame 6. Instead of lugs 30, other attachment means may be used, such as, for example, hooks 31, as shown in the inset to FIG. 5. Loops may be provided on a stretcher sling for cooperation with said hooks 31. Loops are commonly used on known stretcher slings.

Figure 6:
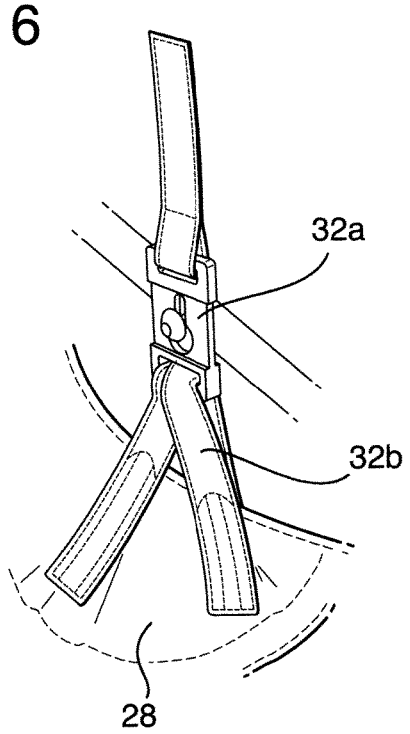
FIG. 6 shows an attachment means provided on a stretcher sling for attaching the sling to e stretcher frame.

FIG. 6 shows attachment means provided on a stretcher sling 28 for attaching the sling to the stretcher frame 6. In FIG. 1 the stretcher sling 28 comprises six attachment straps and associated clips 32 for attachment to the lugs 30 on the stretcher frame. FIG. 6 shows an enlarged image of the clip-sling attachment 32A for attachment to the lugs 30 on the stretcher frame and the strap 32B which passes through the clip 32A and is sewn securely to the stretcher sling 28. Clips are quick and easy to use in order to secure the stretcher sling to a stretcher frame.

Figure 7:
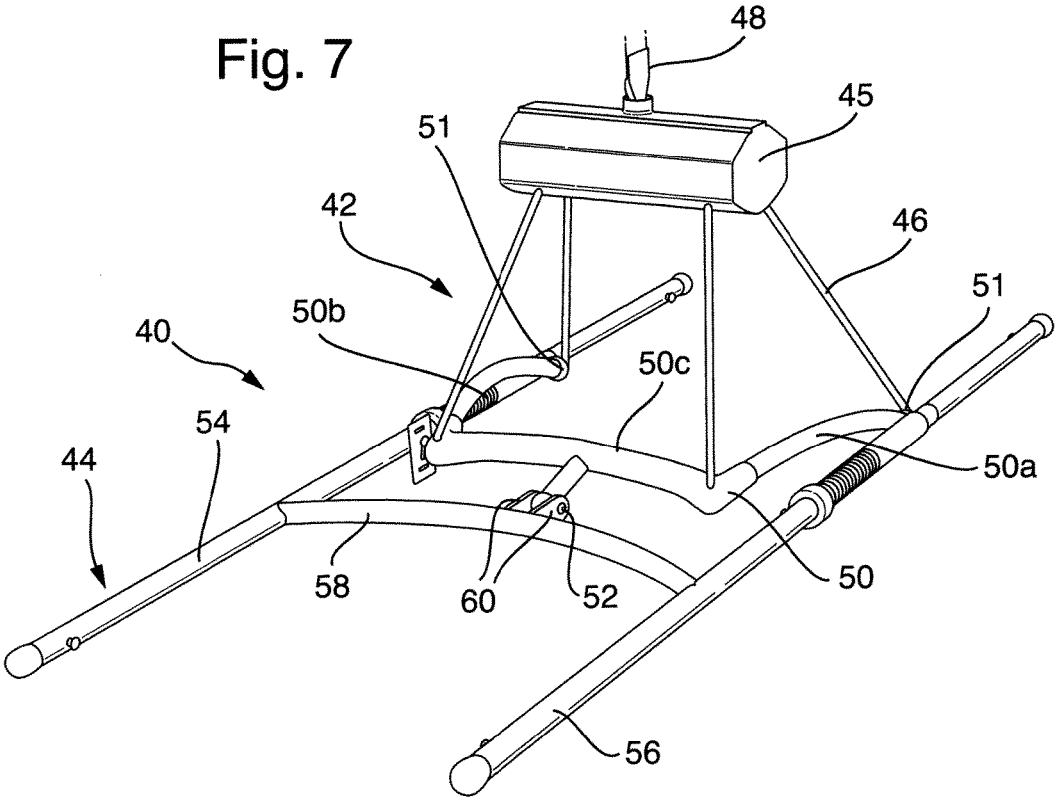
FIG. 7 shows a second hoist apparatus.

FIG. 7 illustrates a second hoist apparatus 40 comprising an intermediate support member in the form of a support 42 and an elongate load bearing member in the form of a stretcher frame 44. Here the support 42 comprises a first support frame 50 and four flexible couplings 46, the flexible couplings are connected to the support frame 50 to a winch member 45. The winch member 45 is approximately cylindrical in shape and has a hoist attachment 48 for attachment to a lifting strap of a ceiling lift. The hoist attachment 48 is located on a first side of the winch member 45, substantially in the centre of the longitudinal length of the cylinder. The four flexible couplings 46 are connected to the winch member 45 on a side of the winch member 45 substantially opposite the first face, two flexible coupling members located at each end of the approximate cylinder and spaced apart around the circumference of the cylinder. The flexible coupling members 46 extend radially away from the winch member 45 to the first support frame 50.

The first support frame 50 has three struts 50*a,b,c* arranged approximately along three sides of a rectangle. In the arrangement shown in FIG. 7 the first strut 50*c* is arranged substantially parallel to the longitudinal length of the substantially cylindrical winch member 45. The second strut 50*a* extends from a first end of the first strut 50*c* and the third strut 50*b* extends from a second end of the first strut 50*c*. Both the second and third struts 50*a,b* extend from the first strut 50*c* in the same direction as one another. A first attachment point 52 comprises a bar having lugs for attachment to the stretcher frame 44 is located at or near the centre of the first strut 50*c*. In this case a longitudinal axis of the first support frame 50 runs substantially parallel to the second and third struts 50*a,b* and through the centre of the third strut 50*c*.

Each of the four flexible coupling members, 46, couples to a different corner of the rectangle. The flexible coupling members 46 may be moved independently of one another by an adjustment means in the form of a winch provided in the winch member 45. Movement of the flexible coupling members 46 results in movement of the first support frame 50 relative to the winch member 45 and thus at least of the stretcher frame first attachment point 52 relative to the hoist attachment 48. As such, the distance between the first attachment point 52 and the hoist attachment 48 is adjusted such that the longitudinal axis of the stretcher frame attached to the support can be orientated relative to the horizontal.

As in FIG. 1, the stretcher frame 44 comprises a generally H-shaped body having two substantially parallel struts 54,56, and across strut 58 joining the substantially parallel struts 54,56. Again the longitudinal axis of the stretcher frame 44 lies along the length of the struts, through the centre of the cross strut 58. The stretcher frame comprises essentially a single unit. The stretcher frame 44 has an attachment hook 60 for attachment to the lugs of the first attachment point 52 on the first support frame 50. The attachment hooks 60 are located at or near the centre of the cross strut 58. The stretcher frame has second attachment points 51 for attachment to attachment features (not shown) on the first support member 50. As described with reference to FIGS. 1 and 2A,B,C, the attachments points 51,52 on the first support member 50 may be suitable for attachment to a known sling, such as a chair sling. By enabling the support 42 to easily attach to the described stretcher frame or a chair sling the support 42 is more versatile. Additionally, attachment points 51,52 are in use when the stretcher frame is attached to the support and thus cannot be used to incorrectly connect a sling body directly to the support.

The stretcher frame 44 further comprises six lugs 62 for attachment to a stretcher sling, as described with reference to FIG. 1.

When the hoist is used to lower a patient onto a surface, there is a risk that the hoist apparatus will be lowered too far, thus resulting in some of the weight of the hoist apparatus being borne by the patient. An advantage of a using a hoist comprising a winch with flexible coupling members coupling the winch to a support frame is that any weight resting on a patient when the hoist apparatus is lowered too far may be reduced as compared to, for example, the weight which may rest on a patient where the support of FIG. 1 is used as the hoist apparatus and said apparatus is lowered too far. The flexible coupling members of the winch result in only the weight of the frame being borne by the patient; the weight of the motor part is still supported by the lifting strap.

Figure 8:
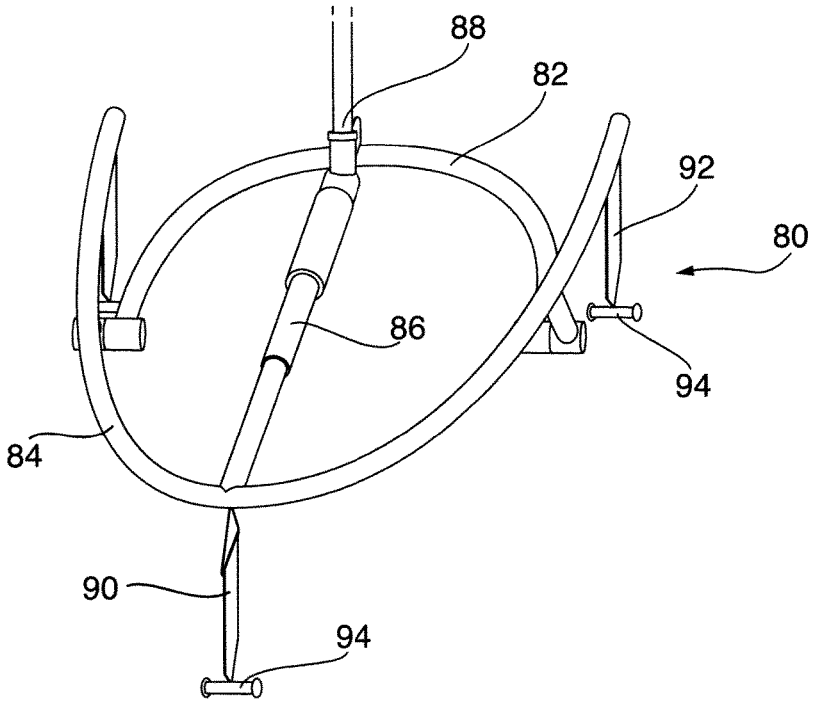
FIG. 8 shows a support of a third hoist apparatus.

FIG. 8 illustrates a support 80, for supporting a stretcher frame, of a third hoist apparatus. As in FIG. 1 the support 80 comprises first and second generally U-shaped members 84,82 joined at their apices by a linear actuator 86. The support 80 is arranged such that the linear actuator is a substantially horizontal linear actuator 86.

As in FIG. 1, the second member 82 is pivotally joined at the ends of its limbs to the limbs of the first member 84. The second member 82 comprises a hoist attachment 88 at its apex for fixing the support 80 to the lifting strap of a ceiling lift. The first member 84 comprises a first attachment point 90 at its apex for attachment to a stretcher frame. The first member 84 comprises second attachment points 92 for attachment to a stretcher frame located proximate the ends of each limb. The attachment points 90,92 for attachment to a stretcher frame may be for attachment to a known sling, such as a chair sling. The attachment points 90,92 are flexible attachments having lugs 94 at their ends.

As described with reference to FIG. 1, contraction or extension of the linear actuator 86 causes the first and second members 84,82 to pivot about their pivot joint and thus changes the distance between the hoist attachment 88 for attachment to a ceiling lift's lifting strap and at least the first attachment point 90 for attachment to the stretcher frame. When in use, actuation of the linear actuator adjusts the orientation of a stretcher attached to the support 80 relative to the horizontal, and thus can act to substantially horizontally balance the stretcher.

The skilled person will understand that the distances between the hoist attachment and the stretcher frame attachments can be adjusted by means other than a linear actuator or a winch. Means such as, for example, rotary gearboxes, bellows or sleds may be used.

It will be understood by the skilled person that the motor unit of the linear actuator 16, or any other actuator, may be actuated by various means such as by voice commands, hand or finger movements that express commands, or strain gauges in the stretcher frame that sense the direction of a force is applied to it. The actuation means may be connected to the motor unit by known means such as by cable or some form of wireless interface such as Infrared, Radio or Ultrasound. As there is no need for a dedicated control panel to control the angle of the stretcher, the hoist apparatus may be controlled without manual intervention from the operative. This leaves the operative's hands free to take care of other matters, such as reassuring or calming the patient for example.

It will also be appreciated that the hoist apparatus described could have an attachment point for attachment to the lifting arm of a sling lift, for example, or another lifting device.

Figure 9:
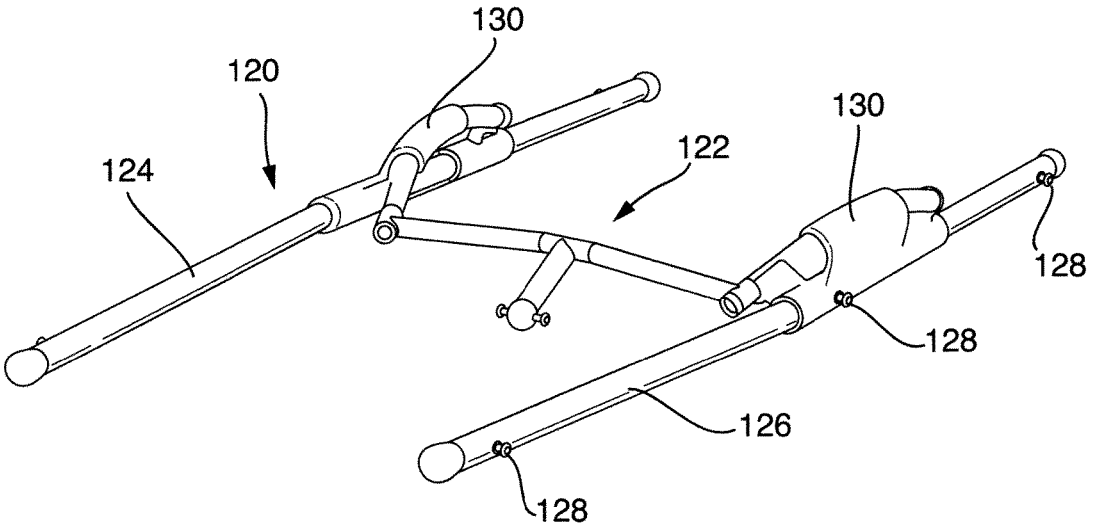
FIG. 9 shows an alternative stretcher frame and part of a further support.

FIG. 9 illustrates an alternative stretcher frame. A multi-piece stretcher frame 120 is attached to a first member 122 of a support as shown in FIG. 2. The stretcher frame 120 comprises two generally linear struts 124,126, each strut 124,126 comprising a hook member 130 for attachment to the second member 122 of the support, the attachment hooks 130 are located proximate the linear centre of the struts 124,126. Each strut 124,126 further comprises three spaced attachment lugs or hooks 128 for attachment to a stretcher sling 28. The attachment points 128 are positioned proximal to each end of each of the struts 124,126 and at or near the centre of each of the struts 124,126.

The skilled person will understand that the stretcher frame may be attached to the support by a number of different attachment means, such as for example clips, pegs, ropes, hooks or other links that allow a simple method to assemble and disassemble the stretcher frame from the support. A multi piece stretcher may facilitate compact storage of the parts.

Figure 10A:
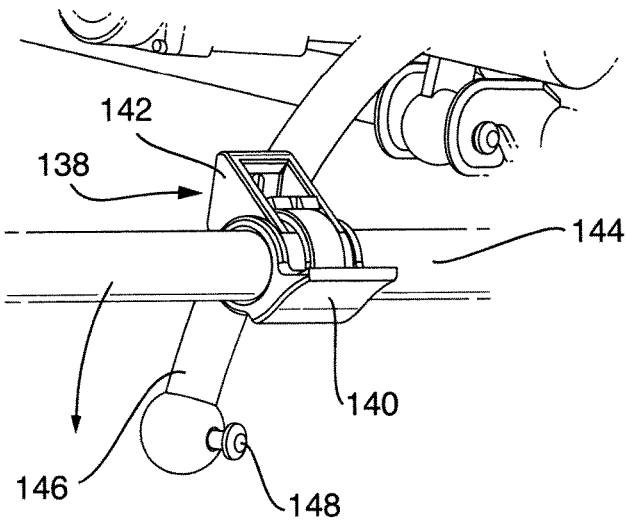
FIGS. 10A, 10B and 10C show stages of a method of use of an alternative attachment means for securing the stretcher frame to a support.

FIGS. 10A, B and C show an alternative locking means 138, located on the stretcher frame 144, for securing the stretcher frame 144 to an attachment lug 148 of the first member 146 of the support. The locking means 138 is used to prevent the first member 146 of the support and stretcher frame 144 from becoming unintentionally detached from one another during use.

Figure 10B:
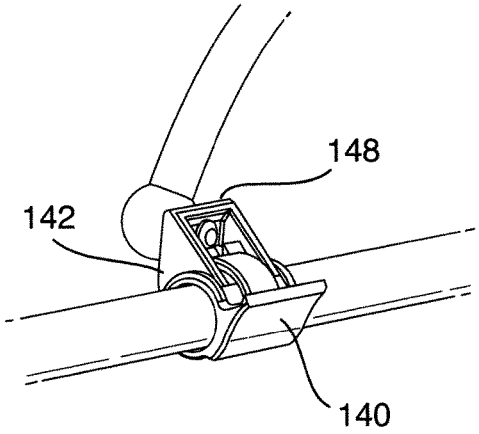
Figure 10C:
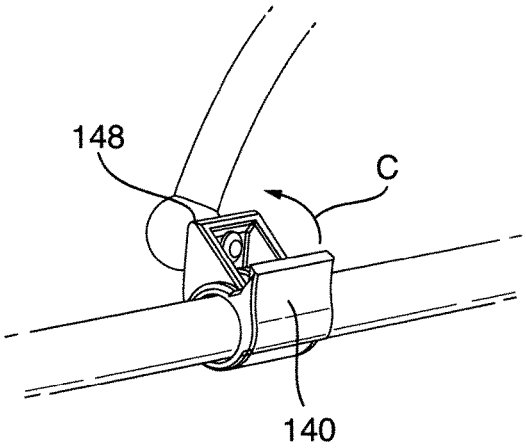

The locking means 138 comprises a suspension point 142 which is brought into engagement with the lug 148 of the first member 146 of the support (FIGS. 10A and 10B), and a latch 140 which locks the suspension point 112 relative to the lug 148 (FIG. 10C).

FIG. 10C shows how the latch rotates, following motion arrow C, about the stretcher frame strut to lock the suspension point 142 relative to the lug 148. The latch comprises a compression spring (not shown) which biases the latch into a locked position. The latch remains in a locked position unless the user applies a counter force to unlock it.

Instead of a compression spring, a tension spring, a torsion spring or a weight may be used. The skilled person will understand that instead of the described latch, a fixed lock comprising pins or hooks or other connections that allow a simple method of securing and un-securing the locking of the stretcher frame to the support.

Figure 11:
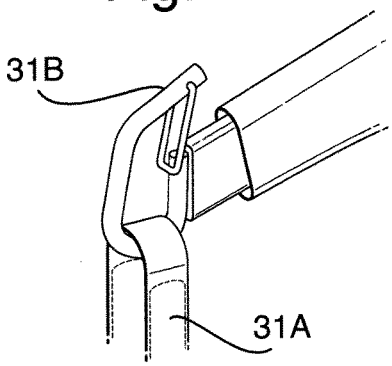
FIG. 11 shows alternative attachment means provided on a stretcher sling for attaching the stretcher sling to the stretcher frame.

FIG. 11 shows alternative attachment means provided on a stretcher sling and stretcher frame for attaching the stretcher sling and the stretcher frame together. These attachment means are known as "loop" slings 31A and are suitable for attachment to rings 31B, or to hooks, as shown in the inset of FIG. 5 (31). Both "clip" slings (as described previously), and "loop" slings are known types of attachment means for slings.

The invention claimed is:

1. A hoist apparatus for use with a hoist for lifting a load, the hoist apparatus comprising:

an elongate load bearing member having a longitudinal axis and comprising elongate frame members and at least one cross strut connecting the elongate frame members;

an intermediate support member comprising:

a first frame member and a second frame member connected to the first frame member;

a hoist connection element for connecting the intermediate support member to the hoist; and at least first and second support point connection elements each connecting the intermediate support member to a respective support point of the elongate load bearing member, the first support point connection element being spaced a first distance from the hoist connection element and connecting the intermediate support member to the cross strut and the second support point connection element being spaced a second distance from the hoist connection element and connected to one of the elongate frame members;

a motor unit controlling a linear actuator that adjusts the angle of the longitudinal axis of the elongate load bearing member relative to the horizontal plane, the linear actuator being connected to the first frame member adjacent the first support point connection element and connected to the hoist connection element; and a control device having an angle sensor for determining the orientation of the longitudinal axis of the elongate load bearing member relative to the horizontal.

2. The hoist apparatus according to claim 1, wherein the elongate load bearing member is detachable from the intermediate support member.

3. The hoist apparatus according to claim 1, wherein the elongate load bearing member comprises at least one of a stretcher frame, or a stretcher comprising a stretcher frame and a sling for attachment to the stretcher frame.

4. The hoist apparatus according to claim 1, wherein the intermediate support member comprises a substantially longitudinal axis along which the at least first and second support point connection elements of the intermediate support member are spaced.

5. The hoist apparatus according to claim 4, wherein the elongate load bearing member is connected to a frame member of the intermediate support member such that the longitudinal axes of the elongate load bearing member and the intermediate support member lie in substantially the same horizontal plane.

6. The hoist apparatus according to claim 1, wherein the intermediate support member comprises a substantially longitudinal axis along which the at least first and second support point connection elements of the intermediate support member are spaced, wherein a frame member of the intermediate support member is substantially planar and lies substantially in a first plane, and wherein the elongate load bearing member is substantially planar, lies substantially in a second plane, and is connected to the first frame member of the intermediate support member such that the first and second planes are substantially coincident.

7. The hoist apparatus according to claim 1, wherein at least one of the at least two support points of the elongate load bearing member and the connected support point connection element of the intermediate support member include a locking means to secure the elongate load bearing member and the intermediate support member together.

8. The hoist apparatus according to claim 1, wherein the control device is programmed to automatically adjust the angle of the longitudinal axis of the elongate load bearing member to a predetermined angle relative to the horizontal plane.

9. The hoist apparatus according to claim 8, wherein if the angle of the longitudinal axis of the elongate load bearing member relative to the horizontal is equal to the predetermined angle, the motor unit does not operate, and wherein if the angle of the longitudinal axis of the elongate load bearing member relative to the horizontal is greater than or less than the predetermined angle, the motor unit operates in a direction to move the elongate load bearing member toward the predetermined angle.

10. A hoist apparatus for use with a hoist for lifting a load, the hoist apparatus comprising:

an elongate load bearing member configured as a stretcher for supporting a patient in a supine position, wherein the stretcher has a longitudinal axis with a stretcher frame comprising elongate frame members and a cross strut connecting the elongate frame members, the stretcher frame connected to a sling for supporting a patient in a supine position and comprises at least two support points, wherein one support point is located on the cross strut;

an intermediate support member including:

a hoist connection element for connecting the intermediate support member to the hoist; and wherein at least first and second support point connection elements of the intermediate support member are detachably connected to a respective support point of the elongate load bearing member, the first support point connection element being spaced a first distance from the hoist connection element and connecting the intermediate support member to the cross strut and the second support point connection element being spaced a second distance from the hoist connection element and connected to one of the elongate frame members; and a motor unit controlling a linear actuator that adjusts the angle of the longitudinal axis of the elongate load bearing member relative to the horizontal plane, the linear actuator being connected to the intermediate support member adjacent the first support point connection element and connected to the hoist connection element.

11. The hoist apparatus of claim 1, wherein the control device is programmed or configured to:

a. receive, from the angle sensor, the actual angle of the stretcher frame relative to the horizontal;

b. compare the actual angle to a desired angle;

c. if the actual angle is different from the desired angle, instruct the motor unit to move the linear actuator in a direction to move the stretcher towards the desired angle; and d. repeat steps a-c. until the actual angle matches the desired angle.

* * * * *